US011309127B2

(12) United States Patent
Winter et al.

(10) Patent No.: US 11,309,127 B2
(45) Date of Patent: Apr. 19, 2022

(54) METHOD AND PLANT FOR THE PRODUCTION OF A STARTING MATERIAL FOR THE PRODUCTION OF RARE EARTH MAGNETS

(71) Applicant: NETZSCH Trockenmahltechnik GmbH, Selb (DE)

(72) Inventors: Frank Winter, Wettenberg (DE); Wilhelm Fernengel, Kleinostheim (DE)

(73) Assignee: NETZSCH Trockenmahltechnik GmbH, Hanau (DE)

( * ) Notice: Subject to any disclaimer, the term of this patent is extended or adjusted under 35 U.S.C. 154(b) by 324 days.

(21) Appl. No.: 16/411,932

(22) Filed: May 14, 2019

(65) Prior Publication Data

US 2019/0362892 A1 Nov. 28, 2019

(30) Foreign Application Priority Data

May 24, 2018 (DE) ..... 102018112411.2

(51) Int. Cl.
*H01F 41/02* (2006.01)
*H01F 1/057* (2006.01)

(52) U.S. Cl.
CPC ..... *H01F 41/0293* (2013.01); *H01F 1/0576* (2013.01)

(58) Field of Classification Search
None
See application file for complete search history.

(56) References Cited

U.S. PATENT DOCUMENTS

2014/0334962 A1* 11/2014 Sun ..... H01F 41/0273 419/28

FOREIGN PATENT DOCUMENTS

| | | | |
|---|---|---|---|
| CN | 203541530 | U | 4/2014 |
| DE | 102013220452 | A1 | 4/2015 |
| JP | H04110404 | A | 4/1992 |

OTHER PUBLICATIONS

Chen (J Appl Phys, 2010, vol. 107, No. 09A730). (Year: 2010).*
Tuunila (Mineral Engineering, 1998, vol. 11, No. 11, p. 1089-1094). (Year: 1998).*

* cited by examiner

*Primary Examiner* — Xiaowei Su
(74) *Attorney, Agent, or Firm* — Whitmyer IP Group LLC

(57) ABSTRACT

A method and a plant for the production of a powdery material, which is provided for the manufacture of rare earth magnets. First of all, at least one magnetic or magnetizable raw material, respectively, is provided and is comminuted into a powdery intermediate product, which includes powder particles including corners and edges, by means of conventional comminuting methods. The sharp-edged powder particles are chamfered subsequently. The optimized powdery product including the chamfered powder particles is used for the manufacture of rare earth magnets.

12 Claims, 3 Drawing Sheets

METHOD AND PLANT FOR THE PRODUCTION OF A STARTING MATERIAL FOR THE PRODUCTION OF RARE EARTH MAGNETS

TECHNICAL FIELD

The present invention relates to a method for the production of a starting material for the production of a rare earth magnet as well as a plant for the production of a starting material for the production of rare earth magnets according to the features of the independent claims.

BACKGROUND

A permanent magnet consists of a magnetizable material, for example, iron, cobalt or nickel, which maintains a static magnetic field, without requiring an electrical current flow, in contrast to electromagnets. A permanent magnet can be created by the impact of a magnetic field on ferromagnetic material.

A group of permanent magnets, which essentially consist of iron metals (iron, cobalt, more rarely nickel) and rare earth metals (in particular neodymium, samarium, praseodymium, dysprosium, terbium, gadolinium), is combined under the name rare earth magnet. Rare earth magnets are characterized in that they have a high magnetic remanence flux density and thus a high magnetic energy density.

Permanent magnets are made of crystalline powder. The magnetic powder is pressed into a mold in the presence of a strong magnetic field. The crystals with their preferred magnetization axes are thereby aligned in the direction of the magnetic field. The moldings are sintered subsequently. In response to the sintering, the pulverized components of the powder are joined or compressed by means of heating, whereby, however, no or at least not all starting materials are melted. The moldings are thereby heated in such a way—often under increased pressure—that the temperatures remain below the melting temperature of the main components, so that the shape (form) of the workpiece is maintained.

For the production of a material, which is required for the manufacture of permanent magnets, in particular of Nd—Fe—B (neodymium-iron-boron) magnets, it is known in the prior art to grind alloys comprising rare earth metal to a powdery intermediate product, for example, in the form of coarse powder or fine powder. The conventional comminution techniques, for example, steam jet mills or the like, are generally suitable for the production of powdery intermediate products.

Due to the fact that the occurrence of rare earth metals is limited, and in particular the extraction thereof is very expensive, old magnets, which are reused and/or recycled for the production of a material for the manufacture of rare earth magnets, in addition to alloys comprising rare earth metal, are also becoming increasingly important for the production of a material for the manufacture of rare earth magnets. The old magnets are, for example, old magnets, which were used in motors or in electrical appliances or the like and which are no longer needed or which do not and/or no longer completely fulfill their desired properties and/or their desired performance, respectively. When using old magnets, this is accordingly also referred to as a recycling material.

It is problematic, however, that powder particles, which have sharp corners and edges, are created in response to the fine grinding of such rare earth magnetic powders by means of conventional methods, for example, in fluidized bed jet mills or similar grinding plants. These sharp corners and edges are highly undesirable for a large variety of reasons, in particular because magnets, which were produced by using such a sharp-edged powder, display inferior magnetic values or lower magnetic energy densities, respectively, than would theoretically be expected, if the existence of rounded powder particles, i.e., without sharp corners and edges, are presumed in the calculations.

SUMMARY

The invention is based on the object of providing a method for the production of a starting material for the manufacture of rare earth magnets, by means of which the sharp corners and edges of the powder particles, which are present in a powdery intermediate product, are at least largely decreased and/or reduced in a simple manner, whereby an optimized starting material for the production of improved rare earth magnets is provided. The method for the production of a powdery starting material for the production of rare earth magnets is to simultaneously be optimized. A plant for the production of a starting material for the manufacture of rare earth magnets is further provided, by means of which the method for the production of a starting material for the production of a rare earth magnet can be carried out in a simple manner and by means of which an optimized starting material for the production of a rare earth magnet can be provided.

The above object is solved by means of a method for the production of a powdery starting material, which is provided for the manufacture of rare earth magnets and a plant for the production of a powdery starting material, which is provided for the manufacture of rare earth magnets, which comprise the features in the independent patent claims. Further advantageous embodiments are described by the subclaims.

In a first step, at least one magnetic or magnetizable raw material, respectively, is provided. This can be, for example, an alloy comprising rare earth metal. In the alternative or in addition, magnetic recycling material can be used, for example, old magnets, which were used in motors and/or in electrical appliances and in each case no longer have any value there for a further use. The at least one magnetic or magnetizable raw material, respectively, or the recycling material, respectively, is preferably alloys containing Nd—Fe—B (neodymium-iron-boron) or Nd—Fe—B (neodymium-iron-boron) magnets.

In a next step, a comminution of the provided magnetic or magnetizable raw material, respectively, takes place, wherein a powdery intermediate product is formed from the at least one magnetic or magnetizable raw material, respectively. It comprises powder particles, which have corners and edges. These corners and edges have the effect that magnets, which are produced from the powdery intermediate material, have a measured magnetic value or a measured value of magnetic energy density, respectively, which lies significantly below a calculated, theoretically expected magnetic value.

The comminution of the magnetic or magnetizable raw material, respectively, thereby takes place in such a way that the powder particles formed thereby of the powdery intermediate product have a particle size of between approximately 2 μm and 10μ, preferably between 3 μm and 5 μm.

The comminution takes place, in particular by means of a comminution apparatus, for example, by means of conventionally known comminution techniques. First coarse comminution for the production of coarse powder with a particle size of approximately 100 μm to 300 μm can take place, for example, with by using mechanical comminution plants and/or by using of hydrogen technology. Grinding plants for the fine grinding, such as, for example, fluidized bed jet mills or similar grinding plants, which are operated, in particular under protective gas, are used for the fine grinding or for the production of fine powder, respectively, with a particle size of approximately 0.1 μm to 20 μm. The used protective gas is typically nitrogen or argon.

In a further step of the method according to the invention, the powder particles of the powdery intermediate product are chamfered, i.e., the corners and edges of the powder particles are rounded off and/or reduced and/or abraded for the most part in a further step. The chamfered powder particles resulting thereby preferably have essentially the same size as the edged powder particles of the powdery intermediate product thereby, namely a particle size of between approximately 2 μm and 10 μm, preferably between 3 μm and 5 μm.

For this purpose, the plant comprises an abrading device, which is embodied for chamfering the angular, sharp-edged powder particles of the powdery intermediate product. The abrading device comprises a receiving chamber, into which the powdery intermediate product is filled. The latter is now swirled around inside the receiving chamber, so that the powder particles rub against each other, whereby the corners and edges are reduced, and are in particular abraded. The filling into the treatment of the powdery intermediate product inside the abrading device preferably takes place by using a protective gas. The powdery intermediate product is machined, in particular for a defined time, for example, between 30 minutes and two hours, preferably for about one hour, in the abrading device. Preferably, 50% to 99% of the receiving chamber of the abrading device is filled with powdery intermediate product, the powdery intermediate product should, in particular fill at least 80% of the receiving chamber. The remaining space inside the receiving chamber of the abrading device is preferably filled by the used protective gas.

As abrading device, a conventional grinding device, for example, can be modified in such a way that the powdery intermediate product is vigorously swirled around inside the modified grinding device on the one hand, so that the powder particles rub against each other. On the other hand, no further grinding of the powdery intermediate product, which would lead to new sharp breaking edges, must take place during the abrasion process. This gentle abrasion process is attained, for example, in that the abrading device/modified grinding device is operated at a low gas pressure, in particular at a gas pressure of between 0.25 bar and 1.00 bar. The gas pressure thereby has to, in particular be adapted in such a way that even though the powder particles of the powdery intermediate product are freely movable for the most part in the abrading device/modified grinding device, whereby the energy of the powder particles is not sufficient for a further grinding. Friction effects between the individual powder particles result in response to the movement of the powder particles in the abrading device/modified grinding device. These friction effects have the effect that the sharp corners and edges of the powdery intermediate product are rounded off significantly, whereby an optimized powdery product with chamfered powder particles is created.

This optimized powdery product can already be used as first starting material for the manufacture of first rare earth magnets. The first rare earth magnets produced by using the first starting material have significantly better magnetic values or higher magnetic energy densities, respectively, than magnets, which are made from the above-described powdery intermediate product.

In the alternative, it is provided that the optimized powdery product is subjected to a classification process in a further method step, in order to remove the very fine abrasion portions accumulating in response to the rubbing of the powder particles inside the abrading device, from the optimized powdery product. A fraction is thereby formed, which only still contains chamfered powder particles of a size between approximately 2 μm and 10 μm, preferably between 3 μm and 5 μm. If this fraction is used as second starting material for the manufacture of second rare earth magnets, product with further improved magnetic values or higher magnetic energy densities, respectively, can then be produced.

A dynamic classifier or a quickly rotating classifier, for example, can be used as separating apparatus for the classification of the optimized powdery product into a fine fraction, comprising the very fine abrasion portions, and a coarse fraction, comprising the desired chamfered powder particles produced from the magnetic or magnetizable raw material, respectively.

Experimental data shows that the first rare earth magnets, which were produced by using chamfered powder particles, and in particular the second rare earth magnets, which were produced by using classified chamfered powder particles, have better magnetic properties, and in particular show magnetic values or magnetic energy densities, respectively, which come closer to the theoretically calculated values.

It is important to mention expressly at this point that all aspects and embodiment alternatives, which have been described in connection with the device according to the invention, equally relate to or can be partial aspects of the method according to the invention. When reference is thus made at one point in the description or also in the claim definitions to certain aspects and/or connections and/or effects with regard to the device according to the invention, this likewise applies for the method according to the invention. The same applies vice versa, so that all aspects and embodiment alternatives, which have been described in connection with the method according to the invention, likewise relate to or can be partial aspects of the device according to the invention. When reference is thus made at one point in the description or also in the claim definitions to certain aspects and/or connections and/or effects with regard to the method according to the invention, this likewise applies for the device according to the invention.

BRIEF DESCRIPTION OF THE DRAWINGS

Exemplary embodiments of the invention and the advantages thereof will be described in more detail below on the basis of the enclosed Figures. The size ratios of the individual elements to one another in the Figures do not always correspond to the actual size ratios, because, for better visualization, some shapes are illustrated in a simplified manner and other shapes are illustrated in an enlarged manner in comparison with other elements.

DETAILED DESCRIPTION

Figure 1:
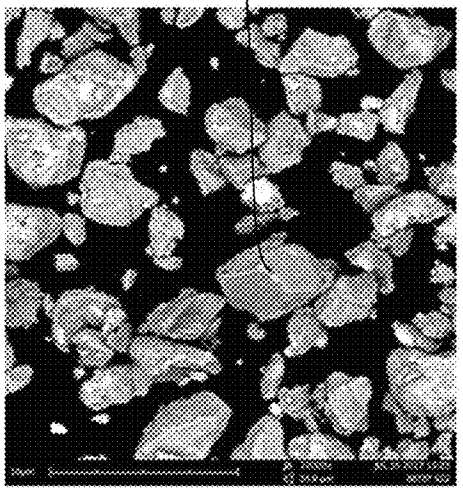
FIG. 1 shows a scanning electron microscopic recording of a conventionally produced rare earth magnetic powder.

Identical reference numerals are used for elements of the invention, which are identical or which have identical effects. For better visualization, only reference numerals, which are required for the description of the respective Figure, are furthermore illustrated in the individual Figures. The illustrated embodiments only represent examples for how the device according to the invention or the method according to the invention can be embodied and do not represent a conclusive limitation.

Figure 2:
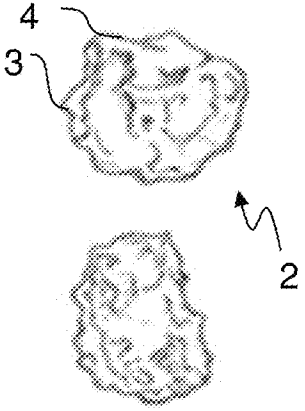
FIG. 2 shows individual particles of a conventionally produced rare earth magnetic powder illustrated schematically in an exemplary manner.

FIG. 1 shows a scanning electron microscopic recording of a conventionally produced rare earth magnetic powder and FIG. 2 shows individual particles 2 of such a conventionally produced rare earth magnetic powder 1 illustrated schematically in an exemplary manner. The production of the rare earth magnetic powder 1 takes place, for example, by grinding of a corresponding raw material. The magnetic or magnetizable raw material, respectively, can be alloys comprising ferromagnetic metals, for example, iron, nickel, cobalt, in particular an alloy of neodymium, iron and boron (NdFeB), or old magnets or mixtures of rare earth alloys and old magnets. The magnetic or magnetizable raw material, respectively, is thereby ground for example, in fluidized bed jet mills or similar grinding plants in such a way that a fine rare earth magnetic powder 1 is created, in the case of which the average particle size (d50-value) of the powder particles 2 lies between 2 μm and 10 μm, preferably between 3 μm and 5 μm.

As can be seen clearly in FIGS. 1 and 2, this rare earth magnetic powder 1 contains powder particles 2 comprising sharp corners 3 and edges 4. If this conventionally produced rare earth magnetic powder 1 is now used for the magnet production, magnets 5 are created (see FIG. 5), the magnetic values or magnetic energy densities of which, respectively, lie significantly below the theoretically calculated values.

Figure 3:
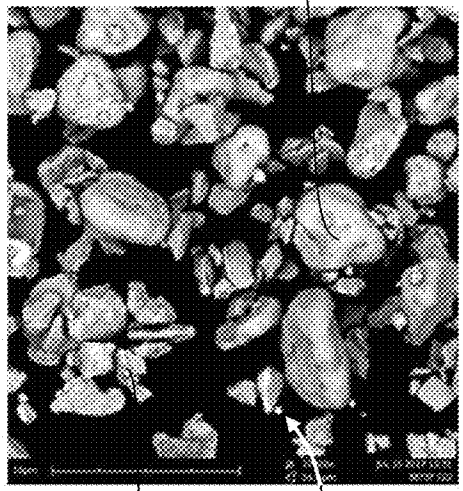
FIG. 3 shows a scanning electron microscopic recording of an optimized starting material for the production of rare earth magnets.
Figure 4:
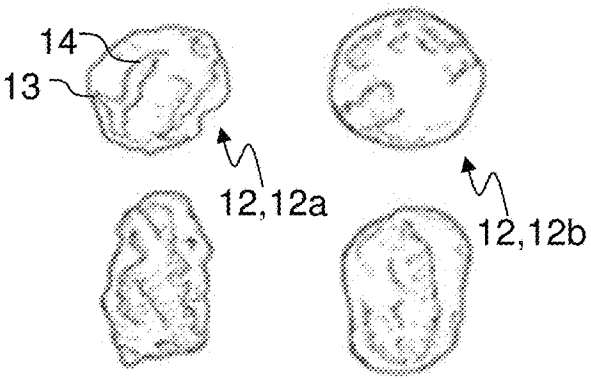
FIG. 4 shows individual particles of the optimized starting material illustrated schematically in an exemplary manner.
Figure 5:
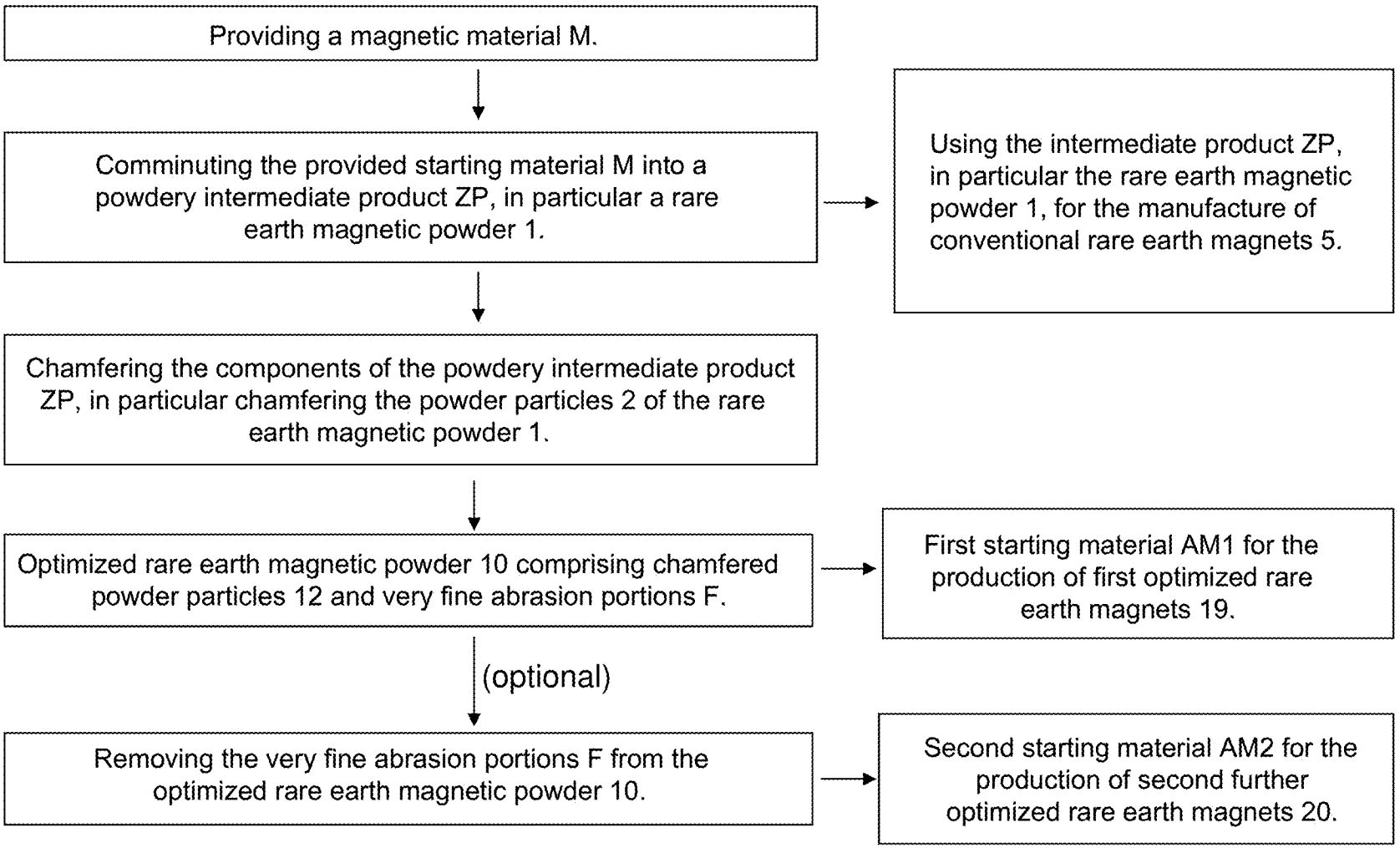
FIG. 5 shows individual method steps for the production of an optimized rare earth magnetic powder for the manufacture of rare earth magnets, based on at least one magnetic or magnetizable raw material, respectively.

FIG. 3 shows a scanning electron microscopic recording of a second optimized starting material AM2 for the production of rare earth magnets 20—see also the figure description of FIG. 5 for this purpose—and FIG. 4 shows individual particles 12, 12*a*, 12*b* of the second optimized starting material AM 2 illustrated schematically in an exemplary manner.

The second optimized starting material AM2 is, in particular produced by means of a method, as it will be described in detail below in connection with FIG. 5. The second optimized starting material AM2 contains, in particular powder particles 12, which, compared to the powder particles 2 of the rare earth magnetic powder 1, only have a significantly reduced number of rounded off corners 13 and rounded off edges 14, in particular slightly rounded and/or rounded off powder particles 12*a* or rounded powder particles 12*b*, respectively.

Figure 6:
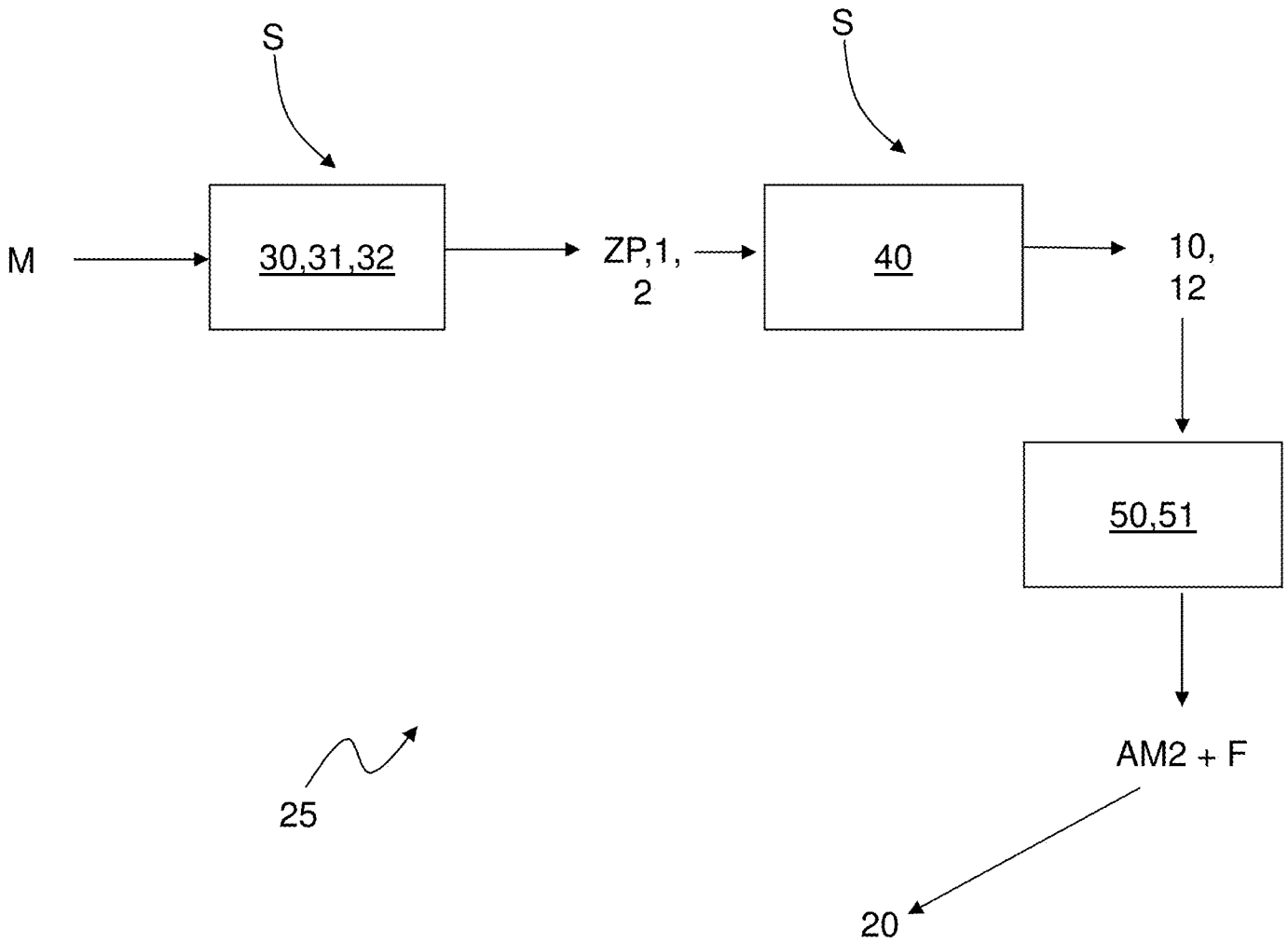
FIG. 6 shows, schematically, a plant for the production of a powdery starting material, which is provided for the manufacture of rare earth magnets.

FIG. 5 shows individual method steps for the production of an optimized starting material AM1, AM2, in particular of an optimized rare earth magnetic powder 10 or of a rare earth magnetic powder, which is further optimized by means of additional classification, for the manufacture of rare earth magnets 19, 20, based on at least one magnetic or magnetizable raw material M, respectively. FIG. 6 shows, schematically, a plant 25 for the production of a powdery starting material AM2, which is provided for the manufacture of rare earth magnets 20.

In a first method step, at least one magnetic or magnetizable raw material M, respectively, is provided. The at least one magnetic or magnetizable raw material M, respectively, is preferably rare earth alloys and/or old magnets, in particular Nd—Fe—B alloys and/or Nd—Fe—B old magnets.

In a next method step, the provided at least one magnetic or magnetizable raw material M, respectively, is comminuted, wherein a powdery intermediate product ZP, in particular a rare earth magnetic powder 1 comprising powder particles 2 comprising corners 3 and edges 4 according to FIGS. 1 and 2, is created from the at least one magnetic or magnetizable raw material M, respectively.

The comminution takes place by means of a comminution apparatus 30, for example, by means of conventionally known comminution techniques. A first coarse comminution for the production of coarse powder with a particle size of approximately 100 μm to 300 μm can take place, for example, by using mechanical comminution plants, such as mills 31, and/or by using hydrogen technology. Grinding plants for the fine grinding, such as, for example, fluidized bed jet mills 32 or similar grinding plants, which are operated, in particular under protective gas S, are used for the fine grinding or for the production of fine powder, respectively, with a particle size of approximately 0.1 μm to 20 μm. The used protective gas is typically nitrogen or argon. A rare earth magnetic powder 1 produced in this way is used, for example, for the production of conventional rare earth magnets 5. In a further method step, this rare earth magnetic powder 1 is now filled into an abrading device 40 under protective gas S and is then moved in this abrading device 40 under protective gas S for a defined period of time. The powder particles 2 of the rare earth magnetic powder 1 are thereby swirled around inside the abrading device 40. The defined period of time for this method step preferably lies between 0.5 hours and 3 hours, in particular at approximately one hour.

The receiving chamber of the abrading device 40 is thereby not completely filled with rare earth magnetic powder 1. The receiving chamber is preferably filled in such a way that the rare earth magnetic powder 1 fills between 50% and 99% of the grinding chamber. The receiving chamber is, in particular filled in such a way that the rare earth magnetic powder 1 fills at least 80% of the receiving chamber. The remaining 20% of the grinding chamber are filled by protective gas S.

The rare earth magnetic powder 1 is vigorously swirled around in the abrading device 40, whereby the corners 3 and edges 4 of the powder particles 2 are abraded among one another on one another by means of mutual rubbing of the powder particles 2. An optimized rare earth magnetic powder 10 with chamfered powder particles 12 according to FIGS. 3 and 4 is created thereby. In particular, no further grinding of the rare earth magnetic powder 1 takes place in the abrading device 40, so that no new sharp corners 3 and breaking edges 4 can be created.

The abrading device 40 is preferably operated at a low gas pressure, for example, at a gas pressure of between 0.25 bar and 1.00 bar. The gas pressure thereby has to, in particular be adapted in such a way that even though the intermediate product ZP or rare earth magnetic powder 1, respectively, can be swirled around in the abrading device 40, so that the powder particles 2 rub against each other, whereby the corners 3 and edges 4 are abraded, and chamfered powder particles 12 according to FIGS. 3 and 4 are formed. The energy of the powder particles 2 and 12, however, must thereby not be sufficient for a further grinding. The conventionally produced rare earth magnetic powder 1 is preferably treated in the abrading device 40 until only rounded powder particles 12*b* according to FIG. 4 are present for the most part.

An optimized rare earth magnetic powder 10, which can now already be used as first starting material AM1 for the production of first optimized rare earth magnets 19, is created by means of the chamfering. However, in addition to the chamfered powder particles 12—see also FIGS. 3 and 4—the optimized rare earth magnetic powder 10 also contains very fine abrasion portions F, which represent, in particular the abrasion of the corners 3 and edges 4 of the powder particles 2 of the rare earth magnetic powder 1. These very fine abrasion portions F are removed in an optional method step, in order to produce a further optimized second starting material AM2 for the production of second further optimized rare earth magnets 20. The very fine abrasion portions F are preferably removed, in that the first optimized rare earth magnetic powder 10 is subsequently classified in a separation apparatus 50, for example, a quickly rotating, dynamic classifier 51, so that the second starting material AM2 for the production of second further optimized rare earth magnets 20 only still contains chamfered powder particles 12.

Experiments have shown that first optimized rare earth magnets 19, and in particular second further optimized rare earth magnets 20 have magnetic values or magnetic energy densities, respectively, which are higher than the magnetic values or magnetic energy densities, respectively, of rare earth magnets 5, which are made of a conventionally produced rare earth magnetic powder 1. The second rare earth magnets 20 of a second optimized starting material AM2, in particular have a magnetic value or a value of the magnetic energy density, respectively, which comes markedly close to a theoretically calculated optimal value.

The embodiments, examples and alternatives of the preceding paragraphs, the claims and the Figures, including their different views or respective individual features, can be used independently of one another or in any combination. Features, which are described in combination with an embodiment, can used for all embodiments, provided that the features are not incompatible.

When reference is also generally made to "schematic" illustrations and views in connection with the Figures, this does in no way suggest that the figure illustrations and the descriptions thereof are to be of minor importance with regard to the disclosure of the invention. The person of skill in the art is absolutely able to gather sufficient information from the illustrations, which are drawn in a schematic and abstract manner, which make it easier for him to understand the invention, without impacting his understanding in any way for instance from the drawn size ratios of the powder particles or other drawn elements, which might possibly not be exactly true to scale. The Figures thus make it possible to the person of skill in the art as reader to derive a better understanding for the ideas of the invention worded in a general and/or abstract manner in the claims as well as in the general part of the description, by means of the concretely described implementations of the method according to the invention and the concretely described mode of operation of the device according to the invention.

The invention has been described with reference to a preferred embodiment. It is conceivable for a person of skill in the art, however, that modifications or changes can be made to the invention, without thereby leaving the scope of protection of the following claims.

The invention claimed is:

1. A method for the production of a powdery starting material, which is provided for the manufacture of rare earth magnets, comprising the following steps:

providing at least one magnetic or magnetizable raw material;

comminuting the at least one magnetic or magnetizable raw material, to create a powdery intermediate product, wherein the powdery intermediate product contains powder particles that have corners and/or edges; and chamfering the powder particles of the powdery intermediate product such that the corners and/or edges thereof are reduced or abraded to be rounded, thereby forming a powdery product, which contains chamfered powder particles;

wherein the method further comprises:

using the powdery product as a first starting material to manufacture first rare earth magnets; or classifying the powdery product, such that abrasion fractions created in response to the chamfering are removed and a fraction including the chamfered powder particles is used as a second starting material to manufacture second rare earth magnets;

wherein an average particle size of the chamfered powder particles of the powdery product and the powder particles of the powdery intermediate product is between approximately 2 μm and 10 μm.

2. The method according to claim 1, wherein the reducing and/or abrading process is performed by means of an abrading device, in which the powder particles of the powdery intermediate product are moved in such a way that the powder particles of the powdery intermediate product rub against each other.

3. The method according to claim 1, wherein the reducing and/or abrading process is carried out by using a protective gas.

4. The method according to claim 2, wherein the abrading device includes a receiving chamber, into which the powder particles of the powdery intermediate product are filled and are moved in such a way that they rub against each other, wherein between 50% and 99% of the receiving chamber is filled with powdery intermediate product.

5. The method according to claim 4, wherein the remaining space inside the receiving chamber is filled by protective gas.

6. The method according to claim 3, wherein the chamfering of the powder particles of the powdery intermediate product is carried out at a gas pressure between 0.25 bar and 1.00 bar.

7. The method according to claim 1, wherein the first rare earth magnets produced by using the powdery product have an increased magnetic value or a higher magnetic energy density as compared to rare earth magnets which are produced by using a powdery intermediate product.

8. The method according to claim 1, wherein the second rare earth magnets produced by using the fraction including the chamfered powder particles have an increased magnetic value or a higher magnetic energy density as compared to rare earth magnets which are produced by using a powdery intermediate product.

9. The method according to claim 2, wherein the abrading process is carried out by using a protective gas.

10. The method according to claim 4, wherein the powdery intermediate product fills at least 80% of the receiving chamber.

11. The method according to claim 1, wherein the chamfering is performed without further comminution.

12. The method according to claim 1, wherein the average particle size of the chamfered powder particles of the powdery product and the powder particles of the powdery intermediate product is between approximately 3 μm and 5 μm.

* * * * *